US006952677B1

(12) United States Patent
Absar et al.

(10) Patent No.: US 6,952,677 B1
(45) Date of Patent: Oct. 4, 2005

(54) FAST FRAME OPTIMIZATION IN AN AUDIO ENCODER

(75) Inventors: Mohammed Javed Absar, Singapore (SG); Sapna George, Singapore (SG); Antonio Mario Alvarez-Tinoco, Singapore (SG)

(73) Assignee: STMicroelectronics Asia Pacific Pte Limited, Singapore (SG)

( * ) Notice: Subject to any disclaimer, the term of this patent is extended or adjusted under 35 U.S.C. 154(b) by 0 days.

(21) Appl. No.: 09/673,463

(22) PCT Filed: Apr. 15, 1998

(86) PCT No.: PCT/SG98/00028

§ 371 (c)(1),
(2), (4) Date: Dec. 7, 2000

(87) PCT Pub. No.: WO99/53479

PCT Pub. Date: Oct. 21, 1999

(51) Int. Cl.[7] ..... G10L 11/00
(52) U.S. Cl. ..... 704/500; 704/230
(58) Field of Search ..... 704/229, 230, 704/500–504; 708/203

(56) References Cited

U.S. PATENT DOCUMENTS 5,109,417 A * 4/1992 Fielder et al. ..... 704/205
5,581,653 A * 12/1996 Todd ..... 704/229
5,752,225 A * 5/1998 Fielder ..... 704/229
5,960,401 A * 9/1999 Rao et al. ..... 704/500
6,061,655 A * 5/2000 Xue et al. ..... 704/500
6,081,783 A * 6/2000 Divine et al. ..... 704/500
6,108,622 A * 8/2000 Xue et al. ..... 704/212
6,112,170 A * 8/2000 Patwardhan et al. ..... 704/212
6,145,007 A * 11/2000 Dokic et al. ..... 709/230
6,253,293 B1 * 6/2001 Rao et al. ..... 711/147
6,356,871 B1 * 3/2002 Hemkumar et al. ..... 704/500
6,430,533 B1 * 8/2002 Kolluru et al. ..... 704/500

* cited by examiner

*Primary Examiner*—Doris H. To
*Assistant Examiner*—Michael N. Opsasnick
(74) *Attorney, Agent, or Firm*—Lisa K. Jorgenson; Robert Iannucci; Seed IP Law Group PLLC

(57) ABSTRACT

In a transform encoder for audio data, encoded data in the form of mantissas, exponents and coupling data is packed into fixed length frames in an output bitstream. The fields within the frame for carrying the different forms of data are variable in length, and apace within the frame must be allocated between them to fit all of the required information into the frame. The space required by the various data types depends on certain encoding parameters, which are calculated for a particular frame before the data is encoded, thus ensuring that the encoded data will fit into the frame before the computationally expensive encoding process is carried out. Information in relation to, for example, transform length, coupling parameters and exponent strategy are determined, which allows the space required for the coupling and exponent data to be calculated. The mantissa encoding parameters can then be iteratively determined so that the encoded mantissas will fit into the frame with the other encoded data. The determined encoding parameters are stored and the audio data is encoded according to those parameters after it has been determined that the encoded data will fit into the frame.

14 Claims, 3 Drawing Sheets

FAST FRAME OPTIMIZATION IN AN AUDIO ENCODER

TECHNICAL FIELD

This invention relates to audio coders, and in particular to the encoding and packing of data into fixed length frames.

BACKGROUND ART

In order to more efficiently broadcast or record audio signals, the amount of information required to represent the audio signals may be reduced. In the case of digital audio signals, the amount of digital information needed to accurately reproduce the original pulse code modulation (PCM) samples may be reduced by applying a digital compression algorithm, resulting in a digitally compressed representation of the original signal. The goal of the digital compression algorithm is to produce a digital representation of an audio signal which, when decoded and reproduced, sounds the same as the original signal, while using a minimum of digital information for the compressed or encoded representation.

Recent advances in audio coding technology have led to high compression ratios while keeping audible degradation in the compressed signal to a minimum. These coders are intended for a variety of applications, including 5.1 channel film soundtracks, HDTV, laser discs and multimedia. Description of one applicable method can be found in the Advanced Television Systems Committee (ATSC) Standard document entitled "Digital Audio Compression. (AC-3) Standard", Document A/52, 20 Dec. 1995, and the disclosure of that document is hereby expressly incorporated herein by reference.

In the basic approach, at the encoder the time domain audio signal is first converted to the frequency domain using a bank of filters. The frequency domain coefficients, thus generated, are converted to fixed point representation. In fixed point syntax, each coefficient is represented as a mantissa and an exponent. The bulk of the compressed bitstream transmitted to the decoder comprises these exponents and mantissas.

The exponents are usually transmitted in their original form. However, each mantissa must be truncated to a fixed or variable number of decimal places. The number of bits to be used for coding each mantissa is obtained from a bit allocation algorithm which may be based on the masking property of the human auditory system. Lower numbers of bits result in higher compression ratios because less space is required to transmit the coefficients. However, this may cause high quantization errors, leading to audible distortion. A good distribution of available bits to each mantissa forms the core of the advanced audio coders.

Further compression is possible by employing differential coding for the exponents. In this case the exponents for a channel are differentially coded across the frequency range. The first exponent is sent as an absolute value. Subsequent exponent information is sent in differential form, subject to a maximum limit. That is, instead of sending actual exponent values, only the difference between exponents is sent. In the extreme case, when exponent sets of several consecutive blocks in a frame are almost identical the exponent set for the first block only are sent. The subsequent blocks in the frame reuse the previously sent exponent values.

In the above mentioned AC-3 standard, the audio blocks and the fields within the blocks have variable lengths. Certain fields, such as exponents, may not be present in a particular audio block, and even if present it may require different number of bits at different times depending an the current strategy used and signal characteristics. The mantissas appear in each block, however the bit allocation for the mantissas is performed globally.

One approach could be to pack all information, excluding the mantissas, for all the audio blocks into the AC-3 frame. The remaining space in the frame is then used to allocate bits to all the mantissas globally. The mantissas for each block, quantized to appropriate bits using the bit allocation output, are then placed in the proper field in the frame. This type of approach is cumbersome and has high memory and computation requirements, and hence is not practical for a real time encoder meant for consumer application.

SUMMARY OF THE INVENTION

In accordance with the present invention, there is provided a method of processing input audio data for compression into an encoded bitstream comprising a series of fixed size frames, each of the fixed size frames having a plurality of variable size fields containing coded data of different types, the method including the steps of:

- receiving input data to be coded into a frame of the output bitstream;
- preprocessing the input data to determine at least one first coding parameter to be used for coding the input data into at least one of the variable size fields in the frame, wherein the value of the at least one first coding parameter affects the data space size required for the at least one variable size field;
- storing the at least one first coding parameter determined in the preprocessing step;
- allocating data space in the frame for at least one other of the variable size fields on the basis of the determined at least one first coding parameter;
- determining at least one second coding parameter for coding data into the at least one other variable sized field on the basis of said allocated space; and
- coding the input data into the variable sized fields of the frame using the first and second coding parameters.

The present invention also provides a method for transform encoding audio data having a plurality of channels for transmission or storage in a fixed length frame of an encoded data bitstream, the frame including variable length fields for encoded exponents, encoded mantissas and coupling data, the method including the steps of:

- obtaining input audio data for a frame;
- determining a transform length parameter for the audio data;
- determining coupling parameters for the audio data;
- determining an exponent strategy for the audio data;
- calculating space required in the frame for the exponent and coupling data fields on the basis of the determined transform length parameter, coupling parameters and exponent strategy;
- calculating space available in the frame for the encoded mantissa field according to the calculated space required in the frame for the exponent and coupling data fields;
- determining a mantissa encoding parameter on the basis of the calculated available space; and
- encoding the audio data into exponent data, mantissa data and coupling data utilising the transform length parameter, coupling parameters, exponent strategy and mantissa encoding parameter, and packing the encoded audio data into the respective fields in the frame.

The present invention further provides a transform audio encoder for encoding audio data having a plurality of channels for transmission or storage in a fixed length frame of an encoded data bitstream, the frame including variable length fields for encoded exponents, encoded mantissas and coupling data, the encoder including:

an input buffer for storing input audio data for a frame;

means for determining a transform length parameter, coupling parameters and an exponent stagy for the audio data;

means for calculating space required in the frame for the exponent and coupling data fields on the basis of the determined transform length parameter, coupling parameters and exponent strategy;

means for calculating space available in the frame for the encoded mantissa field according to the calculated space required in the frame for the exponent and coupling data fields;

means for determining a mantissa encoding parameter on the basis of the calculated available space; and encoding means for encoding the audio data into exponent data, mantissa data and coupling dam utilizing the transform length parameter, coupling parameters, exponent strategy and mantissa encoding parameter, and packing the encoded audio data into the respective fields in the frame.

Preferably the transform audio encoder includes a storage means for storing the transform length parameter, coupling parameters, exponent strategy and mantissa encoding parameter for use by the encoding means in encoding the audio data.

Embodiments of the invention address the problems discussed above by estimating at the beginning of the frame processing the bit-usage for different fields, based upon some basic analysis of the input signal. Given the fixed frame size, the coding strategies for each field are chosen such that the total bits required is within the size of the frame. The iteration for the bit allocation is done at the beginning itself so that at later stage no computationally expensive back-tracking is necessary.

According to the approach described in detail hereinbelow, in the initial stage of the processing of a frame, it is advantageous to perform only the necessary computations which are to be used to base the decisions for the different strategies to be used for coding of different fields throughout the frame. Each such decision is recorded in a table which is used during the later stage.

The processing of the frame can be done in a methodical manner such that the iteration for the bit allocation requires minimal computation. In the initial processing stage of a frame, based on some basic analysis of the signal, all coding strategies for the entire frame such as exponent strategy and coupling coordinate strategy may be determined. Secondly, the bit requirements for each field of the frame, excluding that for mantissas, can be estimated From the knowledge of the bit usage for all fields, the bits available for mantissas is calculated.

Using a Modified Binary Convergence Algorithm (MBCA) the value for the bit allocation parameters, csnroffset and fsnroffset, which lead to a maximum usage of available bits, is determined. A Fast Bit Allocation Algorithm (FBAA) attempts to only estimate the total bits required for mantissas with a particular value of csnroffset and fsnroffset, avoiding all operations which are not necessary for the estimation process.

Once the values for csnroffset and fsnroffset are determined, the frame processing can be performed at block level, in a water-fall method. Since the estimates are always conservative, it is guaranteed at the end of the frame processing the total bits required shall not exceed the specified frame size. This avoids expensive back-tracking unavoidable by other approaches.

BRIEF DESCRIPTION OF THE DRAWINGS

The invention is described in greater detail hereinbelow, by way of example only, through description of embodiments thereof and with reference to the accompanying drawings, wherein.

DETAILED DESCRIPTION OF THE PREFERRED EMBODIMENTS

The input to the AC-3 audio encoder comprises stream of digitized samples of the time domain audio signal. If the stream is multi-channel the samples of each channel appear in interleaved format. The output of the audio encoder is a sequence of synchronization frames of the serial coded audio bit stream. For advanced audio encoders, such as the AC-3, the compression ratio can be over ten times.

Figure 1:
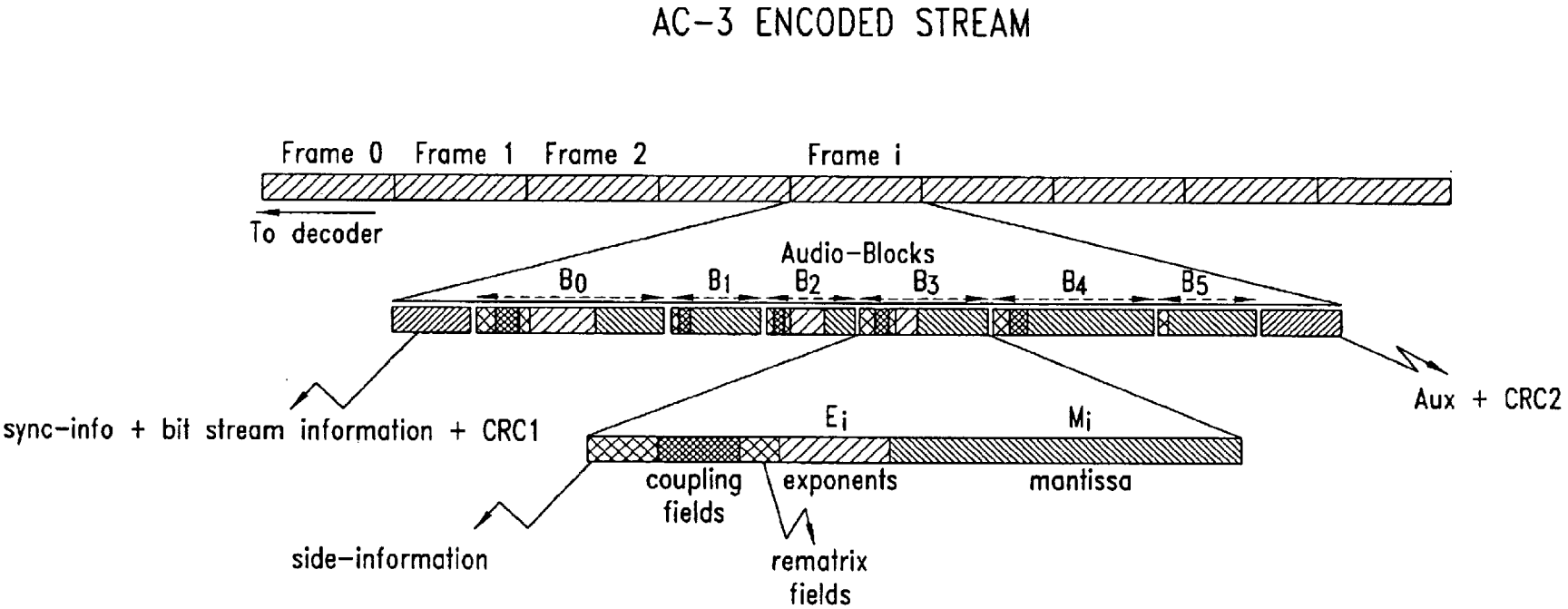
FIG. 1 is a diagrammatic illustration of the data structure of an encoded AC-3 data stream showing the composition and arrangement of data frames and blocks.

FIG. 1 shows the general format of an AC-3 frame. A frame consists of the following distinct data fields:

a synchronization header (sync information, frame size code)

the bit-stream information (information pertaining to the whole frame)

the 6 blocks of packed audio data two CRC error checks

The bulk of the frame size is consumed by the 6 blocks of audio data. Each block is a decodable entity, however not all information to decode a particular block is necessarily included in the block. If information needed to decode blocks can be shared across blocks, then that information is only transmitted as part of the first block in which it is used, and the decoder reuses the same information to decode later blocks.

All information which may be conditionally included in a block is always included in the first block. Thus, a frame is made to be an independent entirety: there is no inter-frame data sharing. This facilitates splicing of encoded data at the frame level, and rapid recovery from transmission error. Since not all necessary information is included in each block, the individual blocks in a frame may vary in size, with the constraint that the sum of all blocks must fit the frame size.

Figure 2:
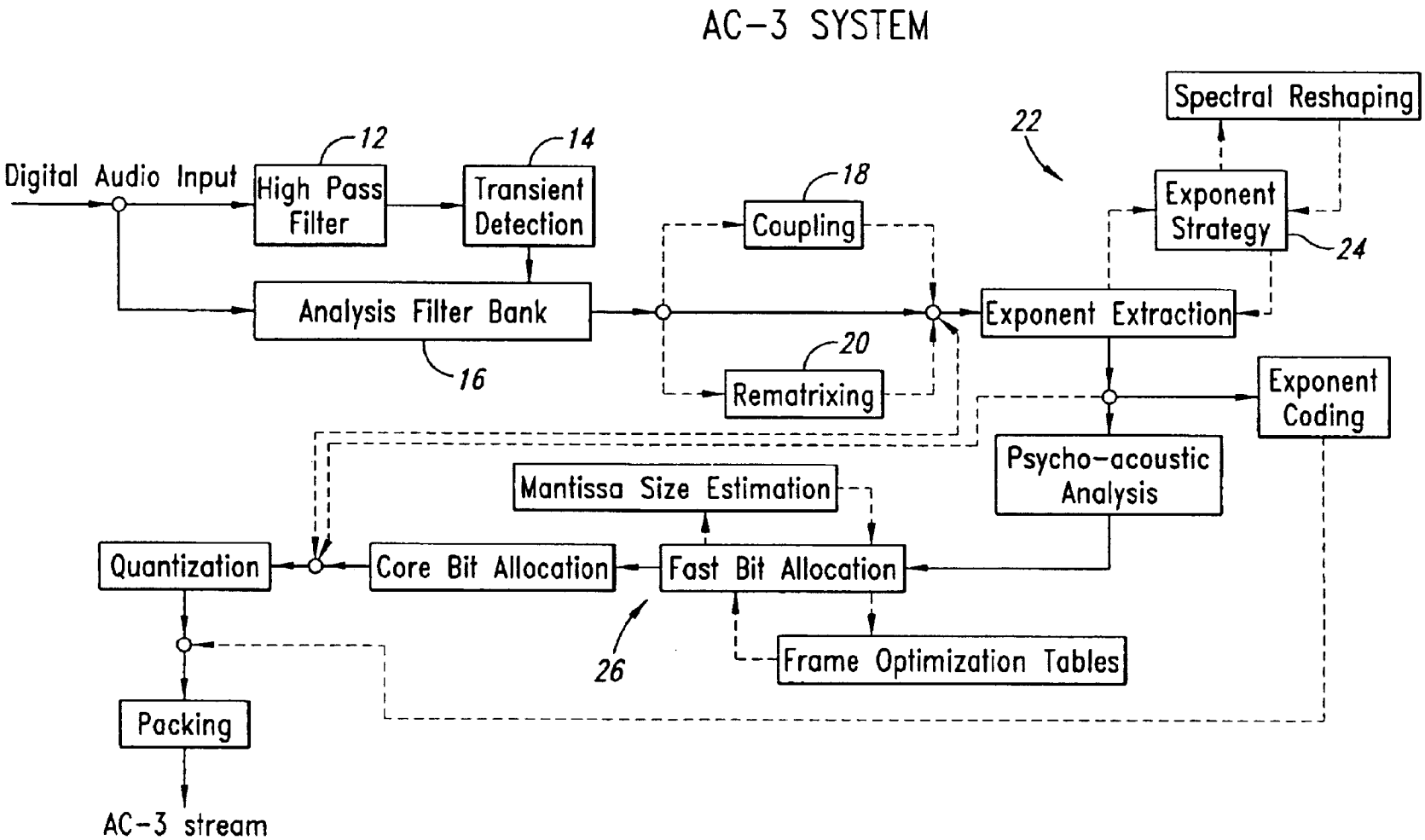
FIG. 2 is diagrammatic block diagram of a digital audio coder according to an embodiment of the present invention.

A form of AC-3 encoder is illustrated in block diagram form in FIG. 2. The major processing blocks of the AC-3 encoder as shown are briefly described below, with special emphasis on issues which are relevant to the present invention.

Input Format

AC-3 is a block structured coder, so one or more blocks of time domain signal, typically 512 samples per block and channel, are collected in an input buffer before proceeding with additional processing.

Transient Detection

Blocks of the input signal for each channel are analysed with a high pass filter 12 to detect the presence of transients 14. This information is used to adjust the block size of the TDAC (time domain aliasing cancellation) filter bank 16, restricting quantization noise associated with the transient within a small temporal region about the transient. In presence of transient the bit 'blksw' for the channel in the encoded bit stream in the particular audio block is set.

TDAC Filter

Each channel's time domain input signal is individually windowed and filtered with a TDAC-based analysis filter bank 16 to generate frequency domain coefficients. If the blksw bit is set, meaning that a transient was detected for the block, then two short transforms of length 256 each are taken, which increases the temporal resolution of the signal. If not set, a single long transform of length 512 is taken, thereby providing a high spectral resolution.

The number of bits to be used for coding each coefficient needs to be obtained next. Lower number of bits result in higher compression ratio because less space is required to transmit the coefficients. However, this may cause high quantization error leading to audible distortion. A good distribution of available bits to each coefficient forms the core of the advanced audio coders.

Coupling Processor (18)

Further compression can be achieved in AC-3 encoder by use of a technique known as coupling. Coupling takes advantage of the way the human ear determines directionality for very high frequency signals. At high audio frequencies (approximately above 4 KHz.), the ear is physically unable to detect individual cycles of an audio waveform and instead responds to the envelope of the waveform. Consequently, the encoder combines the high frequency coefficients of the individual channels to form a common coupling channel. The original channels combined to form the coupling channel are called the coupled channels.

The most basic encoder can form the coupling channel by simply taking the average of all the individual channel coefficients. A more sophisticated encoder could alter the signs of the individual channels before adding them into the sum to avoid phase cancellation.

The generated coupling channel is next sectioned into a number of bands. For each such band and each coupling channel a coupling co-ordinate is transmitted to the decoder. To obtain the high frequency coefficients in any band, for a particular coupled channel, from the coupling channel, the decoder multiplies the coupling channel coefficients in that frequency band by the coupling co-ordinate of that channel for that particular frequency band. For a dual channel encoder a phase correction information is also sent for each frequency band of the coupling channel.

Superior methods of coupling channel formation are discussed in the specification of International Patent Applications PCT/SG97/00076, entitled "Method and Apparatus for Estimation of Coupling Parameters in a Transform Coder for High Quality Audio", and PCT/SG97/00075 entitled "Method and Apparatus for Phase Estimation in a Transform Coder for High Quality Audio". The disclosures of those specifications are hereby expressly incorporated herein by reference.

Rematrixing (20)

An additional process, rematrixing, is invoked in the special case that the encoder is processing two channels only. The sum and difference of the two signals from each channel are calculated on a band by band basis. If, in a given band, the level disparity between the derived (matrixed) signal pair is greater than the corresponding level of the original signal, the matrix pair is chosen instead. More bits are provided in the bit stream to indicate this condition, in response to which the decoder performs a complementary unmatrixing operation to restore the original signals. The rematrix bits are omitted if the coded channels are more than two.

The benefit of this technique is that it avoids directional unmasking if the decoded signals are subsequently processed by a matrix surround processor, such as Dolby (™) Prologic decoder.

Conversion to Floating Point (22)

The transformed values, which may have undergone rematrix and coupling processing, are converted to a specific floating point representation, resulting in separate arrays of binary exponents and mantissas. This floating point arrangement is maintained throughout the remainder of the coding process, until just prior to the decoder's inverse transform, and provides 144 dB dynamic range, as well as allows AC-3 encoder to be implemented on either fixed or floating point hardware.

Coded audio information consists essentially of separate representation of the exponent and mantissas arrays. The remaining coding process focuses individually on reducing the exponent and mantissa data rate.

The exponents are coded using one of the exponent coding strategies. Each mantissa is truncated to a fixed number of binary places. The number of bits to be used for coding each mantissa is to be obtained from a bit allocation algorithm which is based on the masking property of the auditory auditory system.

Exponent Coding Strategy (24)

Exponent values in AC-3 are allowed to range from 0 to −24. The exponent acts as a scale favor for each mantissa equal to $2^{-exp}$. Exponents for coefficients which have more than 24 leading zeros are fixed at −24 and the corresponding mantissas are allowed to have leading zeros.

The AC-3 encoded bit scream contains exponents for independent, coupled and the coupling channels. Exponent information may be shared across blocks within a frame, so blocks 1 through 5 may reuse exponents from previous blocks.

AC-3 exponent transmission employs differential coding technique, in which the exponents for a channel are differentially coded across frequencies. The first exponent is always sent as an absolute value. The value indicates the number of leading zeros of the first transform coefficient. Successive exponents are sent as differential values which must be added to the prior exponent value to form the next actual exponent value.

The difference encoded exponents are next combined into groups. The grouping is done by one of the tree methods: D15, D25 and D45. These together with "reuse" are referred to as exponent strategies. The number of exponents in each group depends only on the exponent strategy. In the D15 mode, each group is formed from three exponents. In D45 four exponents are represented by one differential value. Next, three consecutive such representative differential values are grouped together to form one group. Each group always comprises 7 bits. In case the strategy is "reuse" for a channel in a block, then no exponents are sent for that channel and the decoder reuses the exponents last sent for this channel.

Pre-processing of exponents prior to coding can lead to better audio quality. One such form of processing is described in the specification of PCT/SG98/00002, entitled "Method and Apparatus for Spectral Exponent Reshaping in a Transform Coder for High Quality Audio", the disclosure of which is hereby expressly incorporated herein by reference.

Choice of the suitable strategy for exponent coding forms an important aspect of AC-3. D15 provides the highest accuracy but is low in compression. On the other hand transmitting only one exponent set for a channel in the frame (in the first audio block of the frame) and attempting to "reuse" the same exponents for the next five audio blocks, can lead to high exponent compression but also sometimes very audible distortion.

Several methods exist for determination of exponent strategy. One such method is described in the specification of PCT/SG98/00009, entitled "A Neural Network Based Method for Exponent Coding in a Transform Coder for High Quality Audio", the disclosure of which is hereby expressly incorporated herein by reference.

Bit Allocation for Mantissas (26)

The bit allocation algorithm analyses the spectral envelope of Be audio signal being coded, with respect to masking effects, to determine the number of bits to assign to each transform coefficient mantissa. In the encoder, the bit allocation is recommended to be performed globally on the ensemble of channels as an entity, from a common bit pool.

The bit allocation routine contains a parametric model of the human hearing for estimating a noise level threshold, expressed as a function of frequency, which separates audible from inaudible spectral components. Various parameters of the hearing model can be adjusted by the encoder depending upon the signal characteristics. For example, a prototype masking curve is defined in terms of two piece wise continuous line segment each with its own slope and y-intercept.

Optimization

From the foregoing description, it is clear that audio blocks and the fields within the blocks have variable lengths. Certain fields, such as exponents, may not be present in a particular audio block, and even if present it may occupy different amounts of spare at different times depending on the current strategy used and signal characteristics.

The mantissas appear in each audio block. However the bit allocation for the mantissas must be performed globally.

One solution could be to pack all information, excluding the mantissas, of all blocks into the AC-3 frame. The remaining space in the frame is then used to allocate bits to all mantissas globally. The mantissas for each block, quantized to the appropriate bits using the bit allocation output, are then put in the proper place in the frame. This type of approach is cumbersome and has high memory and computation requirements, and hence is not practical for a real time encoder meant for consumer application.

The key to the problem is estimation at the beginning of the frame processing the bit-usage for different fields, based upon some basic analysis of the input signal. Given the fixed frame size, the coding strategies are chosen such that the total bits required is within the constraint. The iteration for the bit allocation is done at the beginning itself, so that at later stages no computationally expensive back-tracking is necessary.

The recommended approach is—in the initial stage of the processing of a frame, perform only the necessary computations which are to be used to base the decisions for the different strategies for coding of different fields throughout the frame. Each such decision is recorded in a table which is used during the later stage.

For example, the bit usage of exponents is dependent on the exponent coding strategy (24) and the parameters—chbwcod (channel band width code), cplbegf (coupling begin frequency) and cplendf (coupling end frequency). Once the exponent coding strategy for all channels in all blocks is known, the space used by exponents in the frame can be easily calculated. Similarly, knowing whether coupling co-ordinates are to be sent in a block or not, the bit usage by coupling parameters is known immediately.

Using simple techniques as described hereinbelow, it is indeed possible to determine at the initial stage of the frame processing, the bit requirements of each of the fields. Once the bits that would be used by other fields are estimated, the bits that would be available for mantissas is known.

The information of the available bits for mantissa is used to perform "Fast Bit Allocation". This algorithm takes as input the raw masking curve and the available bits for mantissas and determines bit allocation parameters, specifically values of csnroffset and fsnroffset (refer to AC-3 standard document) which lead to optimal utilization of available bits. The term "fast" is used since no mantissa quantization is done in this stage. The iteration just attempts to estimate bit-usage without actually coding the mantissas.

Once the value of csnroffset and fsnroffset is determined, the normal frame processing begins. At each step of the processing, the decision tables are read to decide the strategy for the coding of each field. For example, coupling co-ordinates for a channel ch in audio block blk_no are coded using the strategy "cplcoe [blk_no] [ch]". The mantissas are encoded using the specified csnroffset and fsnroffset. The quantized mantissas can be directly packed into the AC-3 frame since it can be guaranteed that the total size of the bits will not exceed the given frame size.

The memory requirements are minimised by use of this technique since the original mantissas for a block are no longer required once it has been quantized. In the other approach where mantissas are quantized and then the used space is checked against the available one, it is possible that the man may have to be re-quantized later to a different quantization level and hence the original mantissas for all blocks may have to be retained till the end, thus leading to more buffer requirements. In the present approach, the space occupied by a mantissa is released after the quantization, allowing the memory to be reused for other processing. The final bit allocation is performed at the block level, thus bit allocation pointers for all audio blocks do not have to be retained concurrently in the buffer at one time.

The advantages of the recommended method are manifold. Firstly, after the initial processing is done and the strategy decisions are taken, the subsequent processing of the frame is very simplistic. Since estimation of bits for mantissas is done in the initial phase, back-tracking is no longer necessary.

Suppose the mantissas are quantized and packed with certain values for bit allocation parameters. Then it is observed that the bits required exceed the available space. Then quantization and packing with different set of values for bit allocation pointers is performed. This process continues till an optimal solution is found. Such a method is not suited for a real time application.

Or suppose, that exponents of a frame are coded with a certain strategy and at the end of the coding of exponents of the sixth block it is found that the space required by exponents is too less or too much for the given frame size. Then a different set of exponent strategies is selected and exponents are recorded using the new strategy. This again will be too expensive for the real time encoder.

The AC-3 frame has to satisfy certain constraints. For example Page 37, ATSC Standard states that:

1. The size of block 0 and 1 combined will never exceed ⅝ of the frame.
2. The sum of block 5 mantissa data and auxiliary data will never exceed the final ⅜ of the frame.

Now, suppose after processing of block 0 and 1 the first constraint is found to be violated. Then certain strategies (such as exponent coding strategy or bit allocation parameters) will have to be modified to remain within the constraints. This means, block 0 and 1 may need to be re-processed, and in the worst case, several times over before the condition is met. With the help of initial estimates, before the actual processing is done, the strategies can be appropriately modified to satisfy such constraints. This makes sure the encoder does not fail with "killer-bitstreams".

Frame Processing

Figure 3:
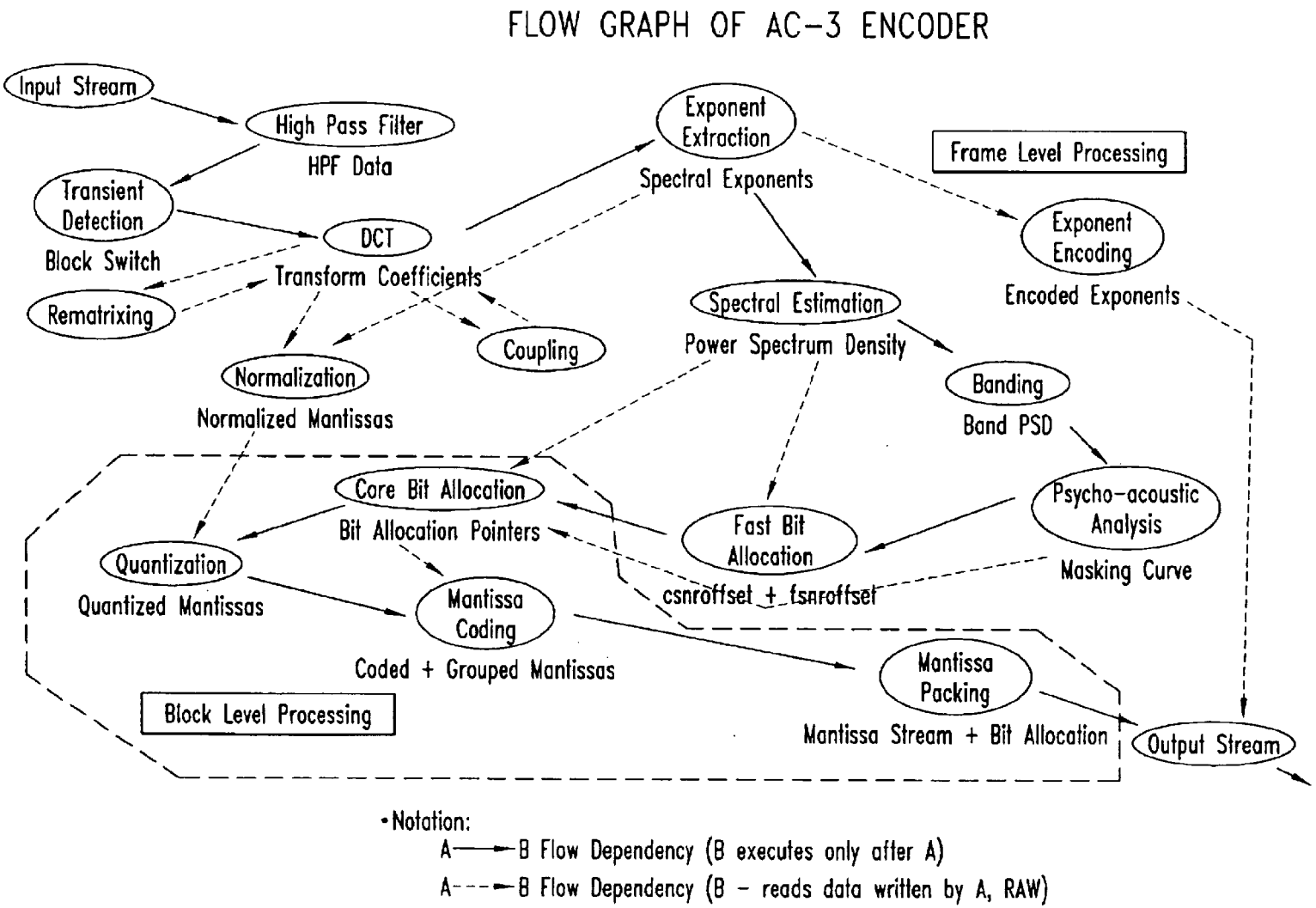
FIG. 3 is a flow diagram of a data processing system or encoding audio data according to an embodiment of the invention

A method for the processing of a frame according to a preferred embodiment of the present invention is described in steps hereinbelow with reference to the flow graph shown in FIG. 3.

Transient Detection

The buffered input is examined to detect the presence of transients. The variable blksw is defined as a two dimensional array that stores information about transients. If 'blksw [blk_no] [ch]=1', then it means channel ch in the audio block 'blk_no' is found to have a transient. If 'blksw [blk_no] [ch]=0' no transient was detected.

Coupling and Rematrixing

Following the suggestion in the AC-3 standard that in presence of transient a channel should not be coupled, the blksw information is used to determine if within a block a channel is to be coupled into the coupling channel.

Even if a transient is not detected, a channel should not be coupled if its signal characteristics are much different than the other coupled channels, otherwise the distortion can increase significantly. That is, if the correlation coefficient of the already coupled channels and the channel to be next coupled is lesser than a given threshold, then the channel should be coded independently and should not be treated as a coupled channel.

The parameter cplinu is used to specify if a channel forms a coupled channel. Thus, if 'chincpl [blk_no] [ch]=1' then it means channel '[ch]' in the audio block 'blk_no' is coupled. If 'chincpl [blk_no] [ch]=0' the channel is to be coded as an independent channel. (Note: The pseudo-code is in C++ format with '//' signifying comments).

```
if (blksw [bfk_no] [ch] = = 0) //transient does not exist
{
if (correlation_factor (blk_no,ch) > min_correlation_limit)
{
   chincpl [blk_no] [ch] = 1; //channel in coupling
}
Else
   chincpl [blk_n] [ch] = 0; //coupling off for this channel
}
else                          //transient exists
chincpl [blk_no] [ch] = 0;//coupling off
```

If the number of channels coupled in a block are more than one then coupling is considered on that audio block and so 'cplinu [blk_no]=1'.

The chincpl and cplinu are used to determine how often the coupling co-ordinates need to be sent. Two approaches can be followed to determine if coupling co-ordinate should be sent for a channel in an audio-block. The simple approach is following the suggestion in the AC-3 standard for the basic encoder that: coupling co-ordinates must be sent in alternate blocks.

For better quality a more deterministic approach can be adopted. Suppose coupling co-ordinate $\Psi_l$ is sent for a block. For the next block the co-ordinates are not sent if the corresponding co-ordinate $\Psi_{l+1}$ for the block is very similar to the coordinate $\Psi_l$ computed for the previous block. The similarity test can be based on a threshold testing. Suppose $\|\Psi_{l+1}-\Psi_l\|<T$, where T is a predefined constant, then no co-ordinates are sent, else the computed co-ordinate $\Psi_{l+1}$ is sent.

It should be noted that in the case that a channel is coupled in block $B_l$ but was not coupled in previous block $B_{l-1}$, but according to specifications of the standard, the co-ordinates must be sent in block $B_l$.

If for a coupled channel 'ch' in the audio block 'block_no' co-ordinates are to be sent, the parameter 'cpcoe [blk_no] [ch]=1'.

Using the information cplinu [blk_no] [ch] and chincpl [blk_no] [ch] and cplcoe [blk_no] [ch] the number of bits used for the coupling information in each block can be estimated.

```
//for estimation of bit usage by coupling-coordinates for (blk_no = 0 ;
blk_no < 6 ; blk_no + +)      //for all blocks
{
  if (cplinu [blk   no])      //coupling in use in this block
  {
    for (ch = 0 ; ch < nfchans ; ch++)
    {
      used_bits + + ; //cplcoe-cplcoordinate exist flag
      if (chincpl [blk_no] [ch] & & cplcoe [blk_no] [ch])
      {
        used_bits + = (2   +            //for mstrcplco
              4*ncplbnd [blk_no] [ch] + //cplcoexp
              4*ncplbnd [blk_no] [ch]) ; //cplcomant
    }
  }
}
```

The variable used_bits maintains a count of the bits used in the frame. Similarly available_bits is the number of free bits available in the frame. The variable ncplbnd represents the number of coupling bands.

The rematrixing for each block is performed next. It is necessary to perform this step before the exponents can be extracted. For rematrix and coupling phase flags, because their bit requirement is very low, a crude figure (based on worst case analysis) can be used. A very precise estimate of their bit consumption is, however, still possible.

The specification of the aforementioned International Patent Application PCT/SG97/00075, entitled "Method and Apparatus for Phase Estimation on in a Transform Coder for High Quality Audio", describes means for determination of the phase flags.

Methods for coupling channel formation are discussed in the specification of the aforementioned International Patent Application PCT/SG97/00076"Method and Apparatus for H on of Coupling Parameters in a Transform Coder for High Quality Audio". The basic operation of the system described therein is presented below for reference.

"Assume that the frequency domain coefficients are identified as:

a, for the first coupled channel, b, for the second coupled channel, c, for the coupling channel, For each sub-band, the value $\Sigma a_1=b_l$ is computed, index i extending over the frequency range of the sub-band. If $\Sigma a_l=b_l>0$, coupling for the sub-band is performed as $c_l=(a_l+b_l)/2$. Similarly, if $\Sigma a_l=b_l<0$, then coupling strategy for the sub-band is as $c_l=(a_l-b)/2$.

Adjacent sub-bands using identical coupling strategies may be grouped together to form one or more coupling bands. However, sub-bands with different coupling strategies must not be banded together. If overall coupling strategy for a band is $c_l=(a_l+b)/2$, ie for all sub-bands comprising the band the phase flag for the band is set to +1, else it is set to −1".

Exponent Strategy

In AC-3 the exponents are used to derive close approximation of the log power spectrum density. The bit allocation algorithm uses the log power spectrum density for allocation bits to mantissa. To compute the total bits requirements for mantissas, therefore, the exponents must be computed before the bit allocation algorithm starts. For that, the exponent strategy for coding of exponents is to be determined.

Several methods exist for determination of exponent strategy. One such method is described in the patent specification entitled "A Neural Network Based Method for Exponent Coding in a Transform Coder for High quality Audio". The algorithm described therein takes as input the exponent set of a channel for each audio block and generates the suitable strategy for coding of each exponent set. The basis of the system described therein can be expressed as follows:

"We define a set of exponent coding strategies $\{S_0, S_1, S_2, \ldots\}$. Let strategy $S_0$ be defined as reuse. That is, if exponent set $E_i=\{e_{i,0}, e_{i,2}, \ldots e_{i+n-1}\}$, uses strategy $S_0$ for coding then essentially no exponent is transmitted. Instead the receiver is directed to use exponents of $E_{i-1}$ as those of exponents $E_1$. Next, let $S_1$ be the exponent coding strategy where all exponents are differentially encoded with the constraint that the difference between any two consecutive exponents is always −1, +1 or 0. That is, for exponent coding strategy $S_1$, the maximum allowed difference, L, equals +/−1. Similarly, for strategy $S_2$, let the maximum allowed difference, L, be +/−2, and so on for $S_3$, $S_4$, . . . .

The inputs $(E_0, E_1, E_2, \ldots, E_{l-1})$ are presented to the neural network system. The output $(o_0, o_1, o_2, \ldots o_{b-1})$ of the system is the exponent strategy corresponding to each exponent set."

For the case of AC-3, the generic coding strategy mentioned above needs to be slightly modified $\{S_0$=Reuse, $S_1$=D45, $S_2$=D25, $S_3$=D15$\}$. However, since the method is essentially based on the similarity test for exponent sets, the neural weights provided in the example of the patent can still be used in this case.

With the knowledge of the exponent strategy the exponent coding and decoding can easily be done. The strategy also helps determine the bits used by exponents.

In AC-3 the first exponent value is always sent as an absolute value with 4-bit resolution. The subsequent exponents are sent as differential values.

Firstly, the starting and ending frequency bins for each channel must be determined. For independent channels they are defined as:

```
startf [block_no] [channel_no] = 0; //starting coefficient
if (cplinu [block_no] [channel_no] && chincpl[blk_no] [ch])
{        //if coupling in use and this channel is a coupled channel
  endf[blk_no] [ch] = 37 + 12 * cplbegf:
}
else      //no coupling or not coupled
{
  endf[blk_no] [ch] = 37 + (3 * (chbwcod + 12));
}
```

For the coupling channel 'startf[blk_no] [ch]=37+12*cplbegf' and 'endf[blk_no] [ch]=37+12*(cplendf+3)'. For the lfe channel the start and end frequency are predefined as 0 and 7, respectively. Using this information, the number of bits for coding of exponents for every channel can be pre-computed as:

For Independent and Coupled Channels

```
exponent_usage [blk_no] [ch] = 4 + 7*truncate
((endf [blk_no] [ch]-1)/3);
                                        //for exp. strategy D15
exponent_usage [blk_no] [ch] = 4 + 7*truncate
((endf [blk_no] [ch]-1)/6);
                                        //for exp. strategy D25
exponent_usage [blk_no] [ch] = 4 + 7*truncate
((endf [blk_no] [ch]-1)/12);
                                        //for exp. strategy D45
```

For the Coupling Channel

```
exponent_usage [blk_no] [ch]
    = 4 + 7*truncate ((endf [blk_no] [ch]-startf [blk_no] [ch])/3);
                                        //for exp. strategy D15
exponent_usage [blk_no] [ch]
    = 4 + 7*truncate ((endf [blk_no] [ch]-startf [blk_no] [ch])/6);
                                        //for exp. strategy D25
exponent_usage [blk_no] [ch] = 4 + 7*truncate ((endf [blk_no] [ch]-
startf[blk_no][ch])/12);
                                        //for exp. strategy D45
```

The lfe always uses 4+7*2=18 bits for the exponents. The exponent usage for each channel within each block is added to variable bit_usage to determine total bit usage.

Exponent Coding and Decoding

After the exponent coding strategy is determined for all the audio-blocks, the exponents are coded accordingly. The coded exponents are next to be decoded so that the exact values of exponents which are seen by the decoders are used by the encoder for the bit allocation algorithm.

However, if using the method described in the specification of the aforementioned International Patent Application PCT/SG98/0002 "Method and Apparatus for Spectral Exponent Reshaping in a Transform Coder for High Quality Audio", the exponents prior to encoding are processed (re-shaped) in a way such that at the end of the processing they already are exactly in the form in which after the coding (at encoder) and decoding (at decoder) they appear at decoder. This means, the extra effort in decoding is avoided.

PSD Integration and Excitation Curve

The decoded exponents are mapped into a 13-bits signed log power spectral density function.

```
psd [blk_no] [ch] [bin] = (3072 − (exponent [blk_no] [ch] [bin] << 7 ));
                                                    [From ATSC Std.]
```

The fine grain PSD values are integrated within each of a multiplicity of ⅙th octave band, using log-addition to give band-psd. From the band-psd the excitation function is computed by applying the prototype masking curve to the integrated PSD spectrum. The result of the computation is then offset downward in amplitude by a pre-defined factor.

Raw Masking Curve

The raw masking (noise level threshold) curve is computed from the excitation function, as shown below. The hearing threshold hth□□ is given in the ATSC standard. The other parameters fscod and dppbcod are predefined constraints.

```
for (bin = startf [blk_no] [ch] ; bin < endf [blk_no] [ch];
bin + +) // all bins
{
  if (bndpsd [blk_no] [ch] [bin] < dbknee)
  {
    excite + = ((dbknee − bndpsd [blk_no] [ch] [bin]) >> 2);
  }
  mask [blk_no] [ch] [bin] = max (excite [blk_no] [ch] [bin],
  hth [fscod] [bin]);
  }
                                                    [From ATSC Std.]
```

Fast Bit Allocation

Using the three pieces of information, namely the PSD, raw masking curve of each channel and the total available bits for all mantissa, iteration for the bit allocation is performed.

It is important to note that the operation described in previous steps do not need to be repeated for the iteration phase. The raw masking curve is for each iteration modified by the values csnroffset and fsnroffset followed by some simple processing, such as table lookup. After each iteration the bits to be allocated for all mantissas is calculated. It the bit usage is more than available, the parameters csnroffset and fsnroffset are decreased.

Similarly, if the bit usage is less than available, the parameters csnroffset and fsnroffset are increased appropriately. The bit allocation pointer is calculated using the routine given below.

```
//calculation for bit allocation pointers
Calculate_Baps (int blk_no, int ch, int csnroffset, int fsnroffset)
{
  do {
  snroffset = ((csnroffset − 15) << 4 + fsnroffset) << 2;
  mask [blk_no] [ch] [j] − = floore;
  if (mask [blk_no] [ch] [j] < 0) {mask [blk_no] [ch] [j] = 0;}
  mask [blk_no] [ch] [j] & = 0x 1 fe0;
  mask [blk_no] [ch] [j] + = floor;
  for (k = i ; min (bndtab[j] + bndsz[j], endf[blk_no] [ch]); k + +)
  {
    address = (psd [blk_no] [ch] [i] − mask [blk_no] [ch] [j]) > > 5;
    address = min (63, max (0,address));
    bap [blk_no] [ch] [i] = quantize_table [baptab [address]] ; i++;
    }
  }while (endf[blk_no] [ch] > bandtab [j + + ]);
}
                                                    [partially From ATSC Std.]
```

The bit-allocation-pointers or baps are used to determine how many bits are required for all the mantissas. Note that certain mantissas in AC-3 (those quantized to levels 3, 5 and 11) are grouped together to provide further compression. This is taken care of to some extent by modifying the quantize_table. For example, in AC-3 three level 1 mantissas are grouped together and stored as a 5 bit value. Thus for level 3 mantissas the quantize_table reads 5/3=1.67 bits.

For the grouping phase, if the number of mantissas of level 3 in a block is not a multiple of three, the last one or two remaining mantissas are coded by considering the third as a zero. To take care of this in the estimation the value of 2*(5/3) is added to the estimate of each block (see pseudo-code below). This compensates slight inaccuracy for level 3 mantissas' estimate. Similarly, for inaccuracies in estimation of level 5 and 11 mantissas, values 2*(7/3) and 1*(7/2) are added to the estimate of each block, respectively. This correction can be seen in the code below.

Note that the effect is that the estimate is always conservative, that it may be more than actual usage but is never otherwise. This is an important characteristic of the proposed method which must be followed at all levels because if at the end of the whole processing it is found that the bits used exceed the available bits, several expensive computations may have to be redone, leading to error in the timing of the system. On the other hand, unused bits detected in the end can pose no such problem as they can always be included as auxiliary bits (dummy bits).

```
//for estimating bit usage by mantissas
Estimate_mantissa_bits (int csnroffset, int fsnroffset)
{
  int mantissa_usage = 0;
for (blk_no = 0 ; blk_no < 6 ; blk_no + +)        //for all blocks
{
  for (cn = 0; ch < no_of_channels ; ch + +)      //for all channels
  {
    Calculate_Baps (blk_no, ch, csnroffset, fsnroffser);
      for (bin = startf[blk_no] [ch] ; bin < endf[blk_no] [ch] ; bin + +)
                                                  //all bins
      {
        mantissa_usage + = bap [blk_no] [ch] [bin];
                                                  //add the mantissa bins
      }
    }
  mantissa_usage + = (10/3 + 14/3 + 7/2);       //conservative estimate
}
  return mantissa_usage;
}
```

The bit usage with the given value of csnroffset and fsnroffset is compared with the estimated available space. If the bit usage is less than available then the csnroffset and fsnroffset value must be accordingly incremented, likewise if usage is more than available then the parameters csnroffset and fsnroffset must be accordingly decremented.

According to AC-3 Standard, csnroffset can have a different value in each audio block, but is fixed within the block for channels. Fsnroffset can be different for each channel within the block. With so many variables, the computation required to finally arrive at the values that lends to minimal signal distortion with the maximum usage of available bits can be very expensive.

The recommendation in the standard for the basic encoder is "The combination of csnroffset and fsnroffset are chosen which uses the largest number of bits without exceeding the frame size. This involves an iterative approach."

For a real time solution, it is very important that the number iterations is minimised. An average DSP core could take from ~1 Mips (million instruction per seconds) for each iteration. Firstly, some simplification is suggested. Since csnroffset and fsnroffset determine approximately the quality, it may not be necessary to have different values across a frame.

To provide a fast convergence for a real time encoder, some reasonable simplifications are made. The simplification recommended is that the iteration be done with only one value of csnroffset and fsnroffset for all audio blocks and all channels.

A linear iteration is definitely non-optimal. In AC-3 csnroffset can have values between 0 to 63. Similarity, fsnroffset is 0 to 15. This means that in the worst case 64+16=80 iterations (~80 Mips) may be required for convergence to the optimal value. Basically, the linear iteration is 0(n), where n is the number of possible values.

A Modified Binary Convergence Algorithm (MBCA) is therefore suggested which in the worst case guarantees convergence in 0(log_n) time.

```
Optimise_csnr (int_available_bits, int begin_csnr, int curr_csnr,
int end_csnr)
{
  used = Estimate_mantissa_bits (cur_csnr, 0 /*fsnr*/);          (1)
  /*termination test */
  if (curr_csnr/2*2 ! = curr_csnr) //if odd                      (2)
  {
    if (used < = available_bits)                                 (3)
  {
      return curr_csnr ; //converged to a value                  (4)
    }
    else
    {
      return curr_csnr − 1 ; //prev.value should be o.k.         (5)
    }
  }
  if (used <= available_bits)                                    (6)
{
  if (available_bits − used < allowed_wastage/*5*/)              (7)
  {
    return curr_csnr;                                            (8)
  }
  else
  {
    return Optimise_csnr (available_bits, curr_csnr,             (9)
      curr_csnr + (end_csnr − curr_csnr)/2, end_csnr);
    }
    else   //currently using more than available
  {
    return Optimise_csnr (available_bits, begin_csnr,            (10)
      begin_csnr + (curr_csnr − begin_csnr)/2, curr_csnr);
  }
}
```

The algorithm is recursive in nature. First time it is called as Optimise_csnr (available_bits, 0, 32, 64). The function Estimate_mantissa_bits is called to determine the bit usage with the csnroffset=32 and fsnroffset=0 (1).

If the used bits are less than available (6), then check if the bits wasted are less than a threshold value (7). If yes, ignore the wastage to produce a fast convergence and therefore return the current csnroffset value as the optimal (8). If not, the new value of csnroffset to be tried with is exactly between curr_csnr=32 and end_csnr=64, that is the next csnroffset=48 (9).

If the used bits are more than available, then the new value of csnroffset to be tried with is exactly between begin_csnr=0 and curr_csnr=32, that is the next csnroffset=16 (10).

The convergence must end when the curr_csnr is an odd value. At this point it means that with curr_csnr-1 bit usage by mantissas is less than available and that with curr_csnr+1 bit usage by mantissas is more than available. If with curr_csnr bit usage by mantissas is less than or equal to available the optimal value is curr_csnr (3) else with curr_csnr-1 (5) bit usage can always be satisfied.

It can be noted that if, with csnroffset=0 the bits required by mantissas is more than available, the some bits from other fields (e.g. exponent field) must be made free to be able to code mantissa bits with a valid csnroffset value. This aspect also highlights the fact that if mantissa optimization is kept as the last processing step a condition can arise in which no valid csnroffset can result in a valid compression.

For example, consider a case where csnroffset=37 is the value for which mantissa usage is optimised. The following traces through the above algorithm to check how it proceeds. At first it is called with Optimise_csnr {available_bits, 0, 32, 64}. Since 37>32, the number of used bits will be less than the available. The function is recursively called as Optimise_csnr (available_bits, 32, 48, 64). Now with curr_csnr=48 the available bits will be less the used. Therefore the function is again recursively called as Optimise_csnr available_bits, 32, 40, 48). Again 40>37, therefore more bits are used than available. The function is called as Optimise_csnr (available_bits, 32, 36, 40). Next Optimise_csnr (available_bits, 36, 37, 38). Therefore it finally converges to a value of 37.

It can be easily seen that Estimate_mantissa_bits is in the worst case called 6 times. Since it is essentially binary, it should noted that $\log_2 64=6$ is not a co-incident. Of course the same algorithm can be used for optimising the value of fsnroffset for the frame. Since fsnroffset value ranges from 0 to 15, in the worst case $\log_2 16=4$ iterations are required. Therefore the optimization of MBCA compared to the linear iterative method is 80/(6+4)=8 times faster.

Normal Frame Processing

After values for csnroffset and fsnroffset have been obtained, the normal processing of the frame continues. Block by block processing is done. The coding of fields are performed according to the table of strategies formed earlier. Coupling co-ordinates and coded exponents are generated according to the strategies devised. In each block the core bit allocation algorithm computes the bit allocation for each mantissa with the pre-defined values of csnroffset and fsnroffset and the mantissas are quantized and packed into the AC-3 stream.

The foregoing detailed description of the preferred implementations of the present invention has be prevented by way of example only, and is not intended to be considered limiting to the invention as defined in the appended claims.

What is claimed is:

1. A method of processing input audio data for compression into an encoded bitstream comprising a series of fixed size frames, each of the fixed size frames having a plurality of variable size fields containing coded data of different types, the method including the steps of:

receiving input data to be coded into a frame of the output bitstream;

preprocessing the input data to determine at least one first coding parameter to be used for coding the input data into at least one of the variable size fields in the frame, wherein the value of the at least one first coding parameter affects the data space size required for the at least one variable size field;

storing the at least one first coding parameter determined in the preprocessing step;

allocation data space in the frame for at least one other of the variable size fields on the basis of the determined at least one first coding parameter;

determining at least one second coding parameter for coding data into the at least one other variable sized field on the basis of said allocated space; and coding the input data into the variable sized fields of the frame using the first and second coding parameters, wherein a transform coding technique is employed such that the coded data includes exponent data and mantissa data, wherein the input audio data includes a plurality of channels and the coded data includes coupling parameters relating to the plurality of channels.

2. A method as claimed in claim 1, wherein the frame is arranged in a plurality of data blocks, each block having the plurality of variable size fields corresponding to different coded data types.

3. A method as claimed in claim 1, wherein the at least one second coding parameter comprises at least one parameter required for coding the mantissa data.

4. A method as claimed in claim 3, wherein the at least one first coding parameter includes an exponent strategy for coding said exponent data.

5. A method as claimed in claim 3, wherein the at least one first coding parameter includes a block switch parameter indicating a transform length for the transform encoding technique.

6. A method as claimed in claim 5, wherein the block switch parameter is determined according to the detection of transients in the input audio data.

7. A method as claimed in claim 1, wherein the input audio data is coded substantially in accordance with the AC-3 audio coding standard.

8. A method of processing input audio data for compression into an encoded bitstream comprising a series of fixed size frames, each of the fixed size frames having a plurality of variable size fields containing coded data of different types, the method including the steps of:

receiving input data to be coded into a frame of the output bitstream;

preprocessing the input data to determine at least one first coding parameter to be used for coding the input data into at least one of the variable size fields in the frame, wherein the value of the at least one first coding parameter affects the data space size required for the at least one variable size field;

storing the at least one first coding parameter determined in the preprocessing step;

allocation data space in the frame for at least one other of the variable size fields on the basis of the determined at least one first coding parameter;

determining at least one second coding parameter for coding data into the at least one other variable sized field on the basis of said allocated space; and coding the input data into the variable sized fields of the frame using the first and second coding parameters, wherein a transform coding technique is employed such that the coded data includes exponent data and mantissa data wherein the at least one second coding parameter comprises at least one parameter required for coding the mantissa data, and wherein the at least one first coding parameter includes a coupling strategy between multiple channels in the input audio data.

9. A method for transform encoding audio data having a plurality of channels for transmission or storage in a fixed length frame of an encoded data bitstream, the frame including variable length fields for encoded exponents, encoded mantissas and coupling data, the method including the steps of:

obtaining input audio data for a frame;

determining a transform length parameter for the audio data;

determining coupling parameters for the audio data;

determining an exponent strategy for the audio data;

calculating space required in the frame for the exponent and coupling data fields on the basis of the determined transform length parameter, coupling parameters and exponent strategy;

calculating space available in the frame for the encoded mantissa field according to the calculated space required in the frame for the exponent and coupling data fields;

determining a mantissa encoding parameter on the basis of the calculated available space; and encoding the audio data into exponent data, mantissa data and coupling data utilizing the transform length parameter, coupling parameters, exponent strategy and mantissa encoding parameter, and packing the encoded audio data into the respective fields in the frame.

10. A method as claimed in claim 9, wherein the mantissa encoding parameter is determined according to an iterative bit allocation algorithm utilizing a power spectral density function and a raw masking curve function for the input audio data, as well as the calculated available space.

11. A method as claimed in claim 9, wherein the audio data is encoded substantially in accordance with the AC-3 audio coding standard, and wherein two mantissa encoding parameters are determined, being csnroffset and fsnroffset.

12. A method as claimed in claim 9 wherein the transform length parameter is determined by a block switch parameter and the block switch parameter is determined by the detection of a transient in the audio input data.

13. A transform audio encoder for encoding audio data having a plurality of channels for transmission or storage in a fixed length frame of an encoded data bitstream, the frame including variable length fields for encoded exponents, encoded mantissas and coupling data, the encoder including:

an input buffer for storing input audio data for a frame;

means for determining a transform length parameter, coupling parameters and an exponent strategy for the audio data;

means for calculating space required in the frame for the exponent and coupling data fields on the basis of the determined transform length parameter, coupling parameters and exponent strategy;

means for calculating space available in the frame for the encoded mantissa field according to the calculated space required in the frame of the exponent and coupling data fields;

means for determining a mantissa encoding parameter on the basis of the calculated available space; and encoding means for encoding the audio data into exponent data, mantissa data and coupling data utilizing the transform length parameter, coupling parameters, exponent strategy and mantissa encoding parameter, and packing the encoded audio data into the respective fields in the frame.

14. A transform audio encoder as claimed in claim 13, including a storage means for storing the transform length parameter, coupling parameters, exponent strategy and mantissa encoding parameter for use by the encoding means in encoding the audio data.

* * * * *